United States Patent [19]

Jensen et al.

[11] 4,129,056

[45] Dec. 12, 1978

[54] PEDAL CONTROL CIRCUITS FOR ELECTRONIC PIANO

[76] Inventors: Richard W. Jensen, 583 Fay Ave., Elmhurst, Ill. 60126; Richard H. Peterson, 11748 Walnut Ridge Dr., Palos Park, Ill. 60464

[21] Appl. No.: 753,144

[22] Filed: Dec. 21, 1976

[51] Int. Cl.[2] ..... G10H 1/02

[52] U.S. Cl. ..... 84/1.26; 84/1.12; 84/1.13; 84/1.24

[58] Field of Search ..... 84/1.12, 1.13, 1.24, 84/1.25, 1.26

[56] References Cited

U.S. PATENT DOCUMENTS

| | | | |
|---|---|---|---|
| 3,444,306 | 5/1969 | Peterson | 84/1.13 |
| 3,516,321 | 6/1970 | Harris | 84/1.13 |
| 3,544,699 | 12/1970 | Harris | 84/1.26 |
| 3,562,400 | 2/1971 | Cutler | 84/1.26 |
| 3,602,628 | 8/1971 | Peterson | 84/1.26 |
| 3,927,594 | 12/1975 | Morita | 84/1.01 X |

*Primary Examiner*—Ulysses Weldon
*Attorney, Agent, or Firm*—Spencer E. Olson

[57] ABSTRACT

Pedal control circuits for use with an electronic musical instrument, such as a piano, which provide control functions analogous to the actions of a sustaining pedal, of a sustenuto pedal, and of a volume pedal of a conventional piano. Damper circuits operable in conjunction with a sustaining pedal provide an effect analogous to the action of the sustaining pedal in a conventional piano, a latching circuit actuated by depression of a sustenuto pedal operates in conjunction with the damper circuits in a manner analogous to the action of a sostenuto pedal in a conventional piano, and a volume pedal and associated circuitry is operative to determine the level of the output tones only at the moment of strike of the keys, an action analogous to that of the volume pedal in a conventional piano.

4 Claims, 3 Drawing Figures

PEDAL CONTROL CIRCUITS FOR ELECTRONIC PIANO

BACKGROUND OF THE INVENTION

This invention relates to electronic musical instruments, and more particularly to pedal control circuits for an electronic piano. Systems are known from Peterson U.S. Pat. Nos. 3,444,306 and 3,602,628 for producing sounds from electronically generated tone signals that substantially duplicate the sounds of a conventional piano. The system described in U.S. Pat. No. 3,602,628 includes a continuously oscillating tone generator, and gating circuits which deliver signals from the tone generator to an output system with a peak intensity proportional to the velocity with which the playing keys are struck. The system also includes a damper circuits which, in conjunction with a sustaining pedal, produces an action analogous to that of the sustaining pedal in a conventional piano.

Conventional pianos, at least the more expensive ones, also include a sostenuto pedal which when operated sustains any notes corresponding to keys that are depressed at the time the sustenuto pedal is depressed, but does not sustain any notes that are played after operation and during the period the sostenuto pedal remains depressed. It is desirable to provide a comparable action, at reasonable cost, in an electronic piano.

Conventional pianos also have a volume pedal, a two-position pedal operative to provide a normal volume in its normal unoperated position and a softer volume in the other position, the level of the tone in either case being determined at the moment that the piano string is struck by a hammer. It is desirable to provide a comparable volume control in electronic pianos, especially in the sense that the level of the tone is determined only at the moment of strike of a key. Indeed, it is desirable to improve upon the volume control of a conventional piano by providing more than two distinct control levels and a wider dynamic range than that of a conventional piano, to permit loud passages to be played with less physical effort and soft passages to be played with more precision.

Accordingly, the object of the present invention is to provide improved pedal control circuits for an electronic piano which operate in conjunction with the associated tone generating system to provide actions analogous to that of a sustaining pedal, of a sostenuto pedal, and of a volume pedal in a conventional piano.

SUMMARY OF THE INVENTION

The pedal control circuits according to the invention are disclosed as incorporated in an electronic piano having the usual playing keys each adapted to be moved between a normal position and an operated position, and wherein the instantaneous intensity of a musical tone generated in response to movement of a playing key to its operated position is determined by the magnitude of a voltage appearing across a capacitor. The piano has a damper circuit including an electronic switch connected to form a discharge path across the capacitor which causes the tone to be quickly damped upon the return of the playing key to its normal position. The sustain action of a conventional piano is duplicated by a sustaining pedal and associated circuitry which when operated disables the damper circuit.

The sostenuto function of a conventional piano is duplicated, in accordance with the invention, by circuit means controlled by a sostenuto pedal which renders the aforementioned damper circuits inoperative with respect to tones corresponding to keys that are being held down at the moment the sostenuto pedal is moved to its operated position, and only those tones. In known electronic piano circuits in which the present pedal circuits may be used, the amplitude of the output tone signals is determined by the level of a voltage appearing across a capacitor at the time a playing key is moved from its normal to its operated position. In accordance with the present invention, a volume pedal, adapted to be moved from one position to one or more other positions, actuates associated circuitry which applies to the aforementioned capacitor a voltage of first predetermined magnitude when the volume pedal is at the one position and voltages of different predetermined magnitudes at the other positions of the pedal.

BRIEF DESCRIPTION OF THE DRAWINGS

Other objects, features and advantages of the invention will become apparent, and its construction and operation better understood, from the following detailed description, taken in conjunction with the accompanying drawings, in which.

DESCRIPTION OF THE PREFERRED EMBODIMENT

Figures 1, 1A:
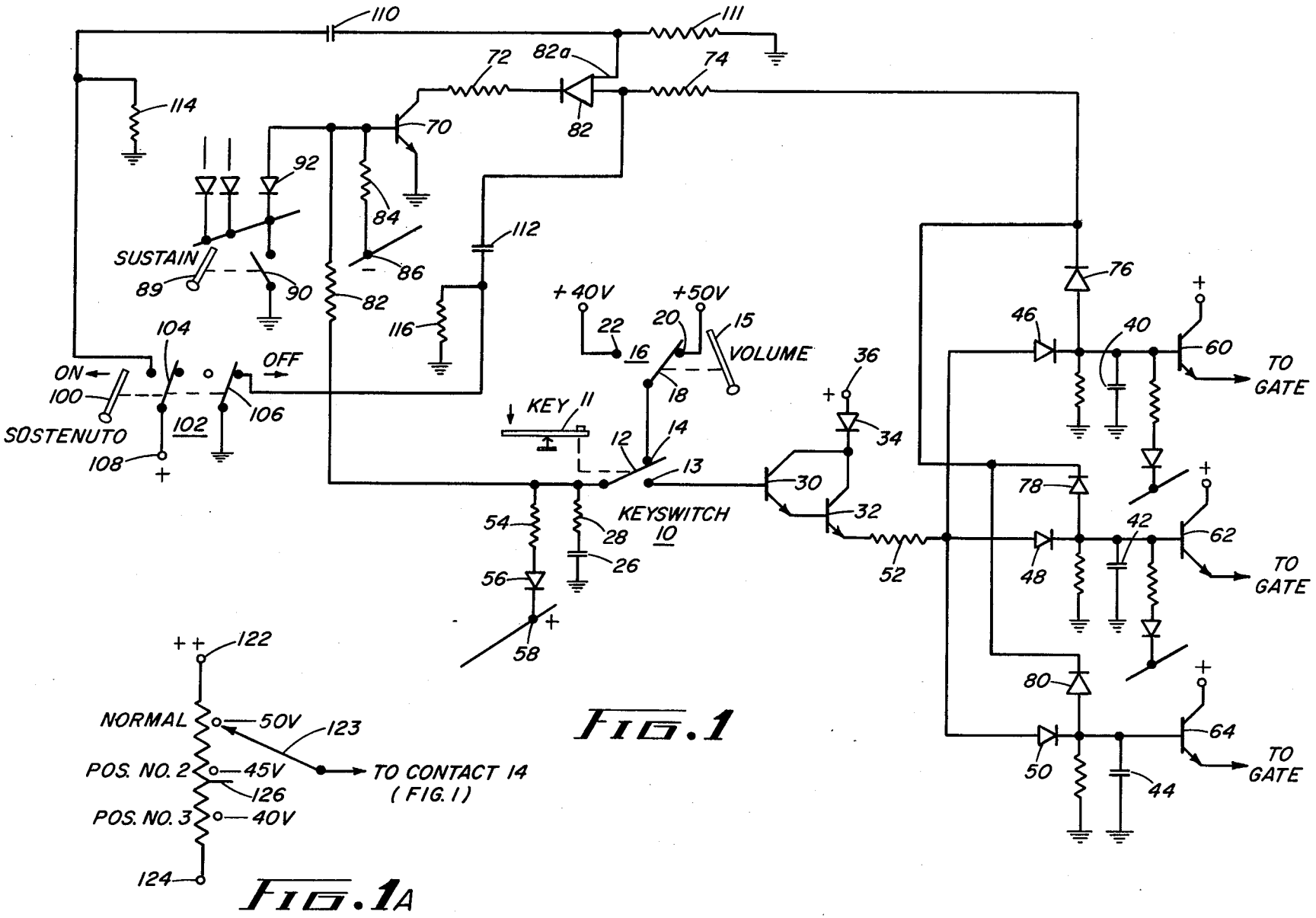
FIG. 1 is a schematic circuit diagram for one note of an electronic piano in which the pedal control circuits of the invention are incorporated.
FIG. 1A is a schematic diagram of an alternate form of a portion of the circuit of FIG. 1.

In the schematic circuit diagram for one note of an electronic piano shown in FIG. 1, each of the 73 or 88 keys that typically make up a piano keyboard operates a keyswitch 10 having a movable contact 12 which engages a fixed contact 14 when the associated key is in its non-operated position. The contact 14 of the switch is connected through another switch 16 the movable contact 18 of which is adapted to be moved between a first fixed contact 20 shown connected to a source of potential labelled +50 volts and a second fixed terminal 22 shown connected to a source of potential labelled +40 volts. Switch 16 is actuated by the volume pedal 15 of the piano, which will be seen from the description to follow is effective to alter the loudness of the generated tones. The keyswitch 10 is operated by a playing key 11 which, in a touch-responsive piano of the kind described in the aforementioned U.S. Pat. No. 3,602,628, rocks on a pivot and is maintained in its usual non-operated position by a suitable weight.

Assuming that the movable contact 18 of the volume pedal switch is connected as shown to a +50 volts source, when the playing key 11 is in its normal position, that is, with the movable contact 12 of the keyswitch engaging stationary contact 14, a capacitor 26 connected from the keyswitch to ground potential is charged through a current-limiting resistor 28. When the key is played, causing the movable switch contact 12 to be moved into engagement with the other fixed contact 13, the charged capacitor 26 is connected to the base of a transistor 30, which with transistor 32 constitutes a Darlington pair; the collector electrodes of the two transistors are connected together and through a diode 34 to a source of positive potential, represented by the terminal 36. The voltage applied to the base electrode of transistor 30 is coupled to the emitter of transistor 32 with sufficiently low impedance to substantially instantly charge three capacitors 40, 42 and 44 through respective coupling diodes 46, 48 and 50. A resistor 52 limits the peak current through transistor 32 to a safe value, and also influences the rate of rise of the voltages that appear across capacitors 40, 42 and 44 when keyswitch 10 is operated.

A network consisting of a resistor 54 and a diode 56 is connected across capacitor 26, the lower terminal of this network being connected to a source of reference potential, represented by the terminal 58. The function of this network is to discharge capacitor 26 at a predetermined rate during the time interval that the movable switch contact 12 has been disconnected from contact 14 and until it makes connection with contact 13. Thus, the potential delivered to the base of transistor 30 is dependent upon the velocity with which the movable switch contact 12 is moved by the playing key from contact 14 into contact with contact 13, as well as on the potential of the reference voltage source 58. The potential at terminal 58, typically +5 volts, sets a minimum threshold for the potential delivered to the base of transistor 30 so that no matter how slowly a playing key is depressed, there will be some charge left on capacitor 26 for application to transistor 30 for charging capacitors 40, 42 and 44.

As soon as capacitor 26 is connected to the base of transistor 30 to cause the charge voltage to appear at the emitter of transistor 32, capacitors 40, 42 and 44 are substantially instantly charged through their respective diodes 46, 48 and 50. These three capacitors and their associated circuit components have different time constants, and the diodes 46, 48 and 50 preclude coupling of signals from one capacitor to another. The ungrounded terminals of capacitors 40, 42 and 44 are connected to the base electrode of respective transistors 60, 62 and 64 which function as capacitor multipliers to harden the voltage appearing at their respective base electrodes better to operate gate circuits (not shown) to which their emitters are connected in the manner described in the aforementioned U.S. Pat. No. 3,602,628. At the moment movable contact 12 of the keyswitch engages the contact 13 there is a sharp rise in the voltage at the emitters of transistors 60, 62 and 64 which thereafter decays with time constants determined by the values of capacitors 40, 42 and 44 and their associated resistors. For example, capacitor 40 and its associated resistors may have a time constant four times as long as that of capacitor 42 and its associated resistors, and the time constant determined by capacitor 44 and its associated resistor may be only one-tenth as long as that of the network including capacitor 40. The three resulting envelope pulses, of different durations, when superimposed and applied to a single gate, or individually applied to three separate gates, produce a composite envelope of appropriate shape to produce piano-like sounds. Operation of a gating circuit by the described envelope-determining signal causes signal to be delivered from the instrument's tone generator to the output system with a predetermined amplitude-versus-time characteristic.

If the system contained only the circuitry thus far described, when the keyswitch 10 is released (that is, with movable contact 12 returned to its normal position in contact with stationary contact 14) capacitors 40, 42 and 44 would continue to discharge through their associated gate circuits and the base circuits of transistors 60, 62 and 64 with a relatively long time constant, and there would not be the damping effect as occurs upon release of a played key of a conventional piano. Accordingly, means must be provided for truncating the otherwise relatively long and gradual decay characteristic of capacitors 40, 42 and 44 so as to terminate the tone promptly, but not instantly, after a key is released. This function is accomplished by a transistor 70, the emitter electrode of which is connected to ground and the collector electrode of which is connected through resistors 72 and 74 and diodes 76, 78 and 80 to the ungrounded terminal of capacitors 40, 42 and 44, respectively. The base electrode of transistor 70 is connected through a resistor 82 to the movable contact 12 of the keyswitch, and through a resistor 84 to a source of negative potential represented by terminal 86, of 20 volts, typically. Ignoring for the moment the programmable unijunction transistor 82 connected between resistors 72 and 74 (that is, assuming a direct connection between these two resistors), when transistor 70 is conducting there is an additional discharge path for each of the capacitors 40, 42 and 44. Transistor 70, which functions as a damper, is rendered conductive or non-conductive depending on the position of the keyswitch 10; except for the first few milliseconds when the movable contact 12 is in transit between the +50 volt bus and switch contact 13, transistor 70 is biased into conduction by the 50 volt potential applied through the keyswitch and to the base of transistor 70 through resistor 82. However, as soon as the movable contact 12 moves away from contact 14, the voltage on capacitor 26 quickly drops, by reason of the network comprising resistor 54, diode 56 and the reference potential 58, to a potential below that of the negative potential at terminal 86, thereby rendering transistor 70 non-conducting. Since the damper circuit includes resistor 72, the rapidity of the damping effect may be changed by adjusting the value of this resistor. A foot-operated pedal 89 is arranged to operate a switch 90 which shorts the base of transistor 70 to ground through a diode 92 whenever the pedal is depressed. This effectively prevents the damper circuit from operating and thus duplicates the action of the sustain pedal in a conventional piano.

In order to provide the sostenuto effect of a conventional piano, the just-described damper path must be disabled, that is, opened, for any notes corresponding to keys that are played and held down at the time the sostenuto pedal is depressed to its "on" condition, so as to sustain such notes, while at the same time not sustaining notes that are played after, and during the period the sostenuto pedal remains depressed. A sostenuto pedal 100 (shown in its "off" position in FIG. 1) when depressed moves the two movable contacts 104 and 106 of a switch 102 to its "on" position, the effect of which will now be described. As previously mentioned, a programmable unijunction transistor 82, hereinafter "PUT", is connected in series with resistors 72 and 74 of the damper circuit. A "PUT" device is normally conductive whenever its anode is at a higher voltage than its cathode, meaning that when a note on the piano is played the charge on capacitors 40, 42 and 44 will appear on the anode of PUT 82, causing it to appear as a closed switch and causing the damper transistor 70 to operate as previously described. If, however, while a note or notes are being played (that is, while one or more keys are depressed, the sostenuto pedal 100 is moved to the "on" position), a positive potential from a voltage source represented by terminal 108 applies a pulse through a capacitor 110 to the gate electrode 82a of the PUT 82, which electrode is returned to ground via a resistor 111, which causes the PUT to be turned off and latched in that condition. This has the effect of opening the damper circuit and the played note or notes will sustain until the capacitors 40, 42 and 44 are completely discharged. If on the other hand, before these capacitors completely discharge, it is desired to eliminate the sostenuto effect, release of the sostenuto pedal and return of the switch 102 to its "off" position grounds the anode of the PUT through capacitor 112 and the movable contact 106 of the switch, thereby to release the latch and again render the PUT conductive. A resistor 114 connected between one terminal of capacitor 110 and ground provides a return path for the capacitor when the sostenuto pedal is returned to its "off" position, and a resistor 116 connected between the lower terminal of capacitor 112 and ground provides a return path for capacitor 112 when the sostenuto pedal is actuated from its "off" to its "on" position so as to ready the circuit for the next actuation of the sostenuto pedal. It will now be apparent that if while one or more played keys are depressed and remain depressed and the sostenuto then operated, so long as the sostenuto pedal is held in its "on" position such notes will be sustained, but any notes that are played after the sostenuto pedal is depressed will not be sustained. This is precisely the action achieved by the sostenuto pedal of a conventional piano.

Another feature of the present invention is the provision of a volume pedal that duplicates or improves upon the action of the volume pedal of a conventional piano. Previous attempts to simulate this action have involved simply connecting an attenuator in the output circuit of the piano when it was desired to deliver a softer tone; that is, as long as the volume pedal was depressed the tone delivered from the loudspeaker of the piano would be a bit softer than when the pedal was not depressed. However, this is not how a conventional piano operates; in the real piano the intensity of the tone is only determined at the moment that the piano string is struck by the hammer, there being no other means by which the volume can be controlled. In accordance with the present invention, a soft pedal that duplicates the effect of the soft pedal of a conventional piano is achieved, in the system shown in FIG. 1, by providing two voltage sources of different potentials, selectable by actuation of a volume pedal, for establishing the initial charge on capacitor 26. More particularly, in a first or normal position of the volume pedal diagrammatically shown at 15, the movable contact 18 of switch 16 is connected to the +50 volt source, and when the volume pedal is depressed the movable contact 18 connects the fixed contact 14 of the keyswitch to a +40 volt source. Consequently, when the volume pedal 17 is depressed the capacitor 26 will be charged to a lower initial potential than when the pedal is not depressed, which materially softens the output tone at the moment of strike, regardless of the velocity of the blow delivered to the key, because of the lower charging voltage delivered to capacitors 40, 42 and 44, and hence the amplitude of the envelope-determining pulses. It should be understood that the potential values of +50 volts and +40 volts are by way of example in the specific disclosed embodiment, and that the differential between the two voltages isn't necessarily limited to 10 volts. However, assuming a potential of +50 volts for the higher of the two, the other potential cannot be lowered beyond that potential at which the damper circuit will no longer operate; it has been experimentally determined that the value of the lower potential can be adjusted over a sufficient range to provide a soft pedal for an electronic piano having a dynamic range equal to or greater than that provided by the soft pedal of a conventional piano.

Whereas the volume pedal of a conventional piano provides only two volume levels, normal and soft, the present invention contemplates the provision of two or more volume levels, or a volume level that is continuously variable, in either case over a wider dynamic range than is achievable with a conventional piano. For example, instead of the two potentials shown in FIG. 1, with the lower potential selected by depressing the volume pedal, a three-level control can be achieved by the circuit schematically illustrated in FIG. 1A comprising a potentiometer connected between a first positive potential represented by terminal 122 of say, +52 volts, and a source of lower positive potential represented by terminal 124, say +38 volts, and having a movable contact 123, which would be connected to the fixed contact 14 of the keyswitch 10 (FIG. 1). The contact 123 is movable under control of a volume pedal from a "normal" position when the pedal is in a normal non-operated position to one of two additional positions, labelled position #2 and position #3, respectively. This is accomplished by the provision of a spring, diagrammatically shown at 126, which resists the movement of the movable contact 123 when it reaches position #2, which resistance may be overcome by causing the spring to yield by pressing harder on the volume pedal to allow contact 123 to be moved to the third and final stop. By designing the potentiometer to provide a potential of +50 volts at the "normal" position, +45 volts at position #2, and +40 volts at position #3, for example, the volume control characteristics can be extended beyond that achievable with a conventional piano. Thus, the described system provides a wide dynamic range, permitting loud passages to be played with less physical effort and permitting soft passages to be played with more precision than is possible with a conventional piano. It follows from the description of FIG. 1A that the volume control can be made continuously variable by eliminating the described "stops" from the potentiometer so as to have essentially the form of a conventional organ-type expression control, while retaining, however, the significant attribute that the level of the tone is determined only at the moment of strike of the piano keys as in a conventional piano.

Although the volume control and sostenuto circuits have been described as incorporated in a touch-responsive electronic piano system of the kind described in U.S. Pat. No. 3,602,628, they are both equally applicable to electronic piano circuits which are not touch-responsive. If, for example, the resistor 54 and diode 56 connected in series across the capacitor 26 were eliminated to render the circuit non-touch-responsive, but otherwise functioning in the same way except that a full volume tone would be delivered every time a key is played, the soft pedal circuit and the sostenuto circuit would operate in the way described. Also, the described sostenuto circuit and volume control circuit would function similarly with other electronic non-touch-responsive piano systems, or key-operated musical instruments other than the piano, that utilize capacitors for determining the instantaneous intensity of a musical tone generated in response to operation of a playing key, and employ damping circuits for discharging such capacitors.

Figure 2:
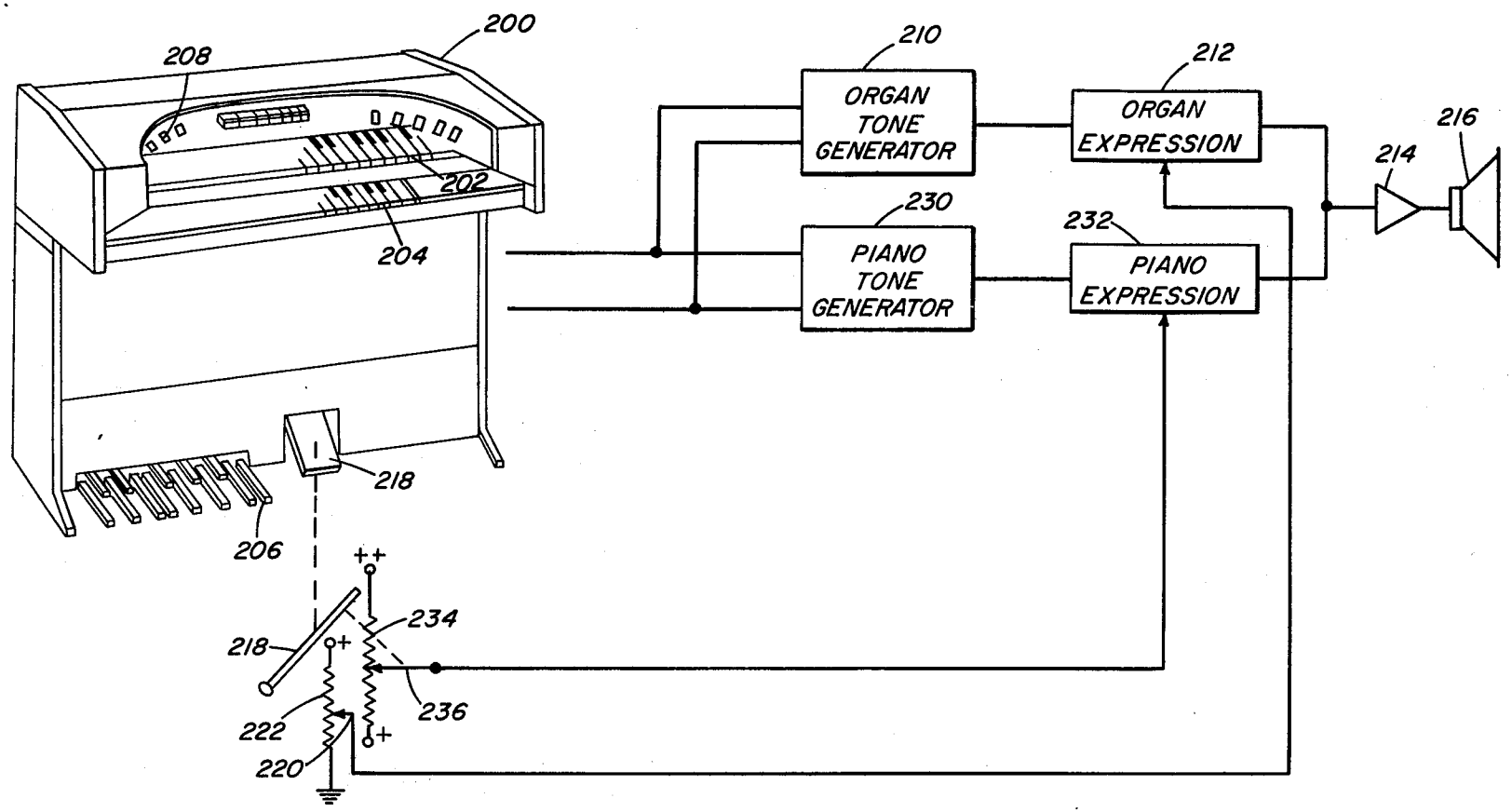
FIG. 2 is a functional block diagram illustrating the incorporation of an improved expression control in an electronic musical instrument which produces both organ and piano voices.

The above-described system for insuring that the loudness of the piano tone is determined at the moment of strike, but which does not affect its volume once the note has been sounded, can be combined with the expression control system of an organ to give combined organ and piano notes a more natural sound than has heretofore been possible in electronic musical instruments. This concept is illustrated in the partially pictorial, partially block diagram of FIG. 2 which shows an electronic organ 200 having conventional keyboards 202 and 204 and a pedal clavier 206. The usual stop controls 208 determine the character of the tone that will be heard when the keys and pedals are played, one of which may be that of a piano. Although the following to be described components or subsystems would be contained within the organ console 200, they are shown in block diagram form outside the console, better to illustrate how the piano volume pedal circuit is incorporated in the organ system. The organ 200 includes a conventional organ tone generator 210, an organ expression device 212, the output of which is amplified in an amplifier 214 prior to application to a loudspeaker 216. The organ expression can be accomplished in several ways, but essentially the device 212 is an audio circuit having an attenuator incorporated therein which is, in turn, adjusted by a foot-operated pedal 218 on the organ. Again, to show how the expression pedal controls the organ expression device 212, the pedal is shown schematically, below the organ console. When the pedal 218 is depressed it changes the position of a movable contact 220 on a potentiometer 222 thereby to vary the potential applied to the organ expression device 212, which, in turn, variably attenuates the tones produced by the organ tone generator.

Played from the same keyboards as the organ tone generator is a piano tone generator 230 the output tones from which are applied to a piano expression device 232, the output of which is amplified by amplifier 214 and applied to loudspeaker 216 for reproduction. It will, of course, be understood that, if desired, the output tones from the piano tone generator can be applied to a separate reproduction channel. The piano expression device 232 is constructed as described in FIGS. 1 and 1A, only the potentiometer which determines the loudness-establishing potential at the moment of strike being shown at 234, the position of the movable contact 236 of which is determined by the position of the foot pedal 218. It is to be understood that the potentiometer 234 corresponds essentially to the circuit of FIG. 1A and would be connected in the system of FIG. 1 in the manner described earlier. Thus, the piano expression device 232 and the potentiometer control therefor determines the loudness of the piano tone at the moment of strike but does not affect the volume of the piano note once it has been sounded. Both of potentiometers 222 and 234 are controlled by the same foot pedal 218; in the case of the organ tones, as the pedal 218 is depressed the tones get louder and if the pedal is backed off the tones get softer. In the case of the piano tones, their loudness is determined by the position of the movable arm 236 (which in turn is determined by the position of the pedal 218), at the moment of strike of a piano key. It will be understood that the potentiometers 222 and 234 are so arranged that the volume of the piano tones increase and decrease in synchronism with changes in loudness of the organ tones. Although both the organ expression and piano expression devices are under common foot pedal control, since they provide a different kind of expression the resulting combination of organ and piano notes sound like two distinct instruments under separate control. The effect is to create a more realistic and a more individualistic identity to the piano voice as compared to the organ voice.

It will have been observed that in the foregoing description the operation of various circuits depends on the charging or discharging of a capacitor. It is to be understood that with suitable reversal of circuit components the "charge" function can be a "discharge" function, and vice versa, and that the term "discharge" as used in the claims is intended to cover such modifications of the circuit as would result in a charge, rather than a discharge, function. Also, although certain elements of the system are sensitive to the amplitude of a voltage, it will be recognized that by appropriate rearrangement of the circuit such elements could be made sensitive to the magnitude of a current without departing from the spirit of the invention. It is intended, therefore, that terms in the claims such as "having an amplitude determined by the magnitude of a voltage" shall also cover such modifications.

We claim:

1. In an electronic musical instrument including a plurality of playing keys each adapted to be moved between a normal position and an operated position and wherein the instantaneous intensity of a musical tone generated in response to movement of a playing key to its operated position is determined by the magnitude of a voltage appearing across a capacitor, a damper circuit including an electronic switch in series with an impedance connected to form a discharge path across said capacitor, a sustaining pedal operative when moved from a normal position to an operated position to disable said damper circuit, and means associated with said playing key for rendering said damper circuit operative upon return of said playing key from its operated to its normal position, the improvement comprising:

a sostenuto pedal adapted to be moved between a normal position and an operated position, and circuit means controlled by said sostenuto pedal for rendering said damper circuit inoperative with respect to musical tones corresponding to those playing keys, and only such keys, as are in the operated position at the moment said sostenuto pedal is moved to its operated position.

2. Apparatus according to claim 1 wherein said means for rendering said damper circuit inoperative comprises:

a programmable unijunction transistor connected in said damper circuit, said programmable unijunction transistor having cathode, anode, and gate electrodes, means for transiently applying a voltage to the gate electrode of said programmable unijunction transistor upon movement of said sustenuto pedal to its operated position to cause the programmable unijunction transistor to latch in its open circuit state, and means operative in response to return of said sustenuto pedal to its normal position to transiently reduce the anode-to-cathode current of said programmable unijunction transistor to a level to cause the programmable unijunction transistor to latch in its closed circuit state.

3. In an electronic musical instrument having a plurality of playing keys each adapted to be moved between a nomal and an operated position and including a first capacitor connected to be rapidly charged when said playing key is in its normal position, means including a second capacitor associated with said playing key for rapidly charging said second capacitor to a potential dependent upon the velocity with which said playing key is moved between its normal and its operated positions, damper circuit means including a first electronic switching device and forming a path for discharging said second capacitor with a relatively short time constant, and means associated with said playing key for rendering said damper circuit means operative whenever said playing key is in its normal position, the improvement comprising:

a sostenuto pedal adapted to be moved between a normal position and an operated position and operative to close a switch when in the operated position, a second electronic switching device connected in said damper circuit means, and latching means associated with said second electronic switching device and operative in response to closure of said switch and the presence of a potential across said second capacitor for latching said second electronic switching device in an open circuit state and rendering said damper circuit means inoperative with respect to musical tones corresponding to those playing keys, and only such keys, as are in the operated position at the moment said switch is closed.

4. Apparatus according to claim 3, wherein said second electronic switching device is a programmable unijunction transistor having cathode, anode and gate electrodes, wherein said switch when closed applies a transient voltage to the gate electrode of said programmable unijunction transistor for latching it in its open circuit state, and further including means operative in response to return of said sostenuto pedal to its normal position for causing said programmable unijunction transistor to latch in its closed circuit state.

* * * * *